United States Patent [19]

Berggren et al.

[11] Patent Number: 4,476,363

[45] Date of Patent: Oct. 9, 1984

[54] METHOD AND DEVICE FOR HEATING BY MICROWAVE ENERGY

[75] Inventors: Benny Berggren, Vällingby; Yngve Hässler, Lidingö, both of Sweden

[73] Assignee: Stiftelsen Institutet For Mikrovagsteknik Vid Tekniska Hogskolan i Stockholm, Stockholm, Sweden

[21] Appl. No.: 528,791

[22] Filed: Sep. 2, 1983

Related U.S. Application Data

[63] Continuation of Ser. No. 218,639, Dec. 22, 1980, abandoned.

[30] Foreign Application Priority Data

Jan. 3, 1980 [SE] Sweden ..... 8000059

[51] Int. Cl.[3] ..... H05B 6/70

[52] U.S. Cl. ..... 219/10.55 A; 219/10.55 F; 219/10.55 M; 333/113; 333/239

[58] Field of Search ..... 219/10.55 F, 10.55 A, 219/10.55 R, 10.55 M; 333/113, 114, 157, 158, 239

[56] References Cited

U.S. PATENT DOCUMENTS

| | | | |
|---|---|---|---|
| 2,602,859 | 7/1952 | Moreno | 333/114 |
| 2,948,864 | 8/1960 | Miller | 333/113 |
| 3,098,983 | 7/1963 | Oliner | 333/113 |
| 3,465,114 | 9/1969 | Bleackley et al. | 219/10.55 A |
| 3,851,132 | 11/1974 | Van Koughnett | 219/10.55 A |
| 3,999,026 | 12/1976 | Böling | 219/10.55 A |
| 4,128,751 | 12/1978 | Sale | 219/10.55 A |

*Primary Examiner*—Roy N. Envall, Jr.
*Assistant Examiner*—Philip H. Leung
*Attorney, Agent, or Firm*—LeBlanc, Nolan, Shur & Nies

[57] ABSTRACT

A method of heating objects by microwave energy by supplying microwave energy from a generator to a first waveguide. A second waveguide is located, separated from the first waveguide except for at least one parallel and adjacent coupling distance at a common wall between the waveguides. A coupling of microwave energy distributed in the wave propogation direction of the waveguides takes place at the coupling distance so that microwave energy passes from one waveguide to the other one. The second waveguide is dimensioned, so that action of load (objects being heated) conducts microwave energy in the second waveguide with the same wave phase constant as the first waveguide. Objects to be heated are fed only into and out of said second waveguide. A uniform field is fed-in only into the first waveguide. A uniform field distribution and heating profile is obtained and leakage of microwave energy from the open ended second waveguide is avoided.

19 Claims, 7 Drawing Figures

METHOD AND DEVICE FOR HEATING BY MICROWAVE ENERGY

CROSS REFERENCE TO RELATED APPLICATION

Figure 1:
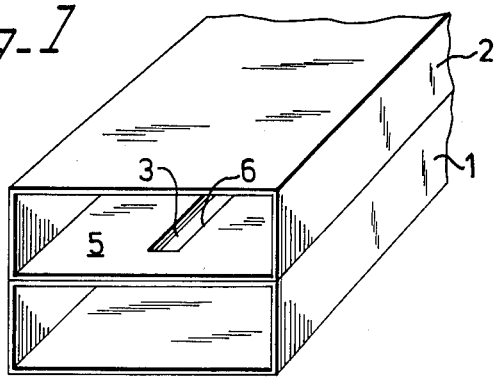

This application is a continuation of application Ser. No. 218,639, filed Dec. 22, 1980 now abandoned.

This invention relates to a method and a device for heating by means of microwave energy. When objects, for example goods, are heated according to methods and by devices using microwave energy, a problem, which arises generally at the heating of continuously passing objects, is that microwave energy radiates out of the heating space when this is open in one or several directions.

It has not been possible, for example, to continuously feed objects into and out of a heating device and simultaneously to prevent microwave energy from radiating out of the heating device through the discharge and/or feed-in opening thereof.

A further great problem has been to be able to feed-in sufficient effect into a space, in which objects are to be heated, and into which the objects continuously have to be fed and, respectively, to be discharged therefrom.

With known devices, moreover, interferences of the field distribution are obtained either at the place of applicator connection or at the feed-in place of load into the waveguide, resulting in that the intended heating pattern is not achieved.

The present invention solves these problems and in addition provides great possibilities for improving and simplifying in many ways the heating of objects by microwave energy.

The present invention, thus, relates to a method of heating objects by microwave energy, comprising the supply of microwave energy from a generator to a first waveguide.

The invention is characterized in that an additional, a second waveguide is provided which is separated from the first waveguide except for at least one coupling distance between the waveguides, which coupling distance is a distance, during and by means of which a coupling of microwave energy distributed in the wave propagation direction of the waveguides is caused to take place so, that microwave energy passes from one waveguide to the other one, in that the second waveguide is dimensioned so as by action of load in the form of said object to conduct microwave energy at the same propagation velocity as the first waveguide, and that said object to be heated only is fed into and out of the second waveguide, and microwave energy is fed only into the first waveguide.

This invention also pertains to a novel device for heating objects by means of microwave energy, including a generator for the supply of microwave energy to a first feed waveguide, together with an additional second load waveguide, which is located in side-by-side relationship to the first waveguide so that the two waveguides at least along a certain distance have a partition wall in common. The partition wall includes a coupling distance which consists of a distance which can comprise a slit, a row of holes or corresponding such units through the wall, by means of which coupling distance, a coupling of microwave energy distributed in the wave propagation direction of the waveguides takes place from one waveguide to the other one, and the second waveguide is dimensioned so as, by action of intended load in the form of objects to be heated in the load waveguide, to conduct microwave energy with the same propagation constant as the first waveguide.

Figure 2:
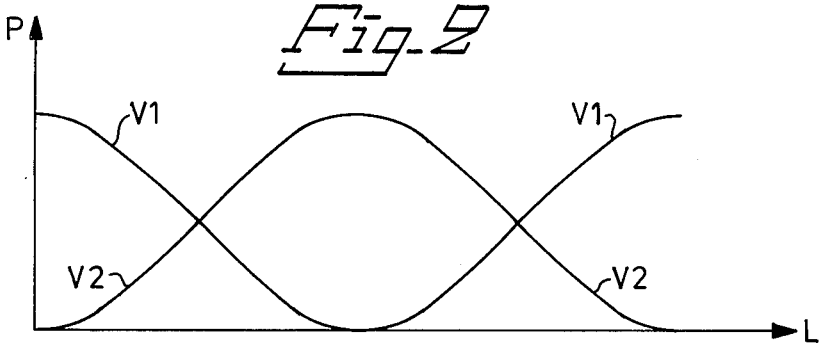
Figure 3:
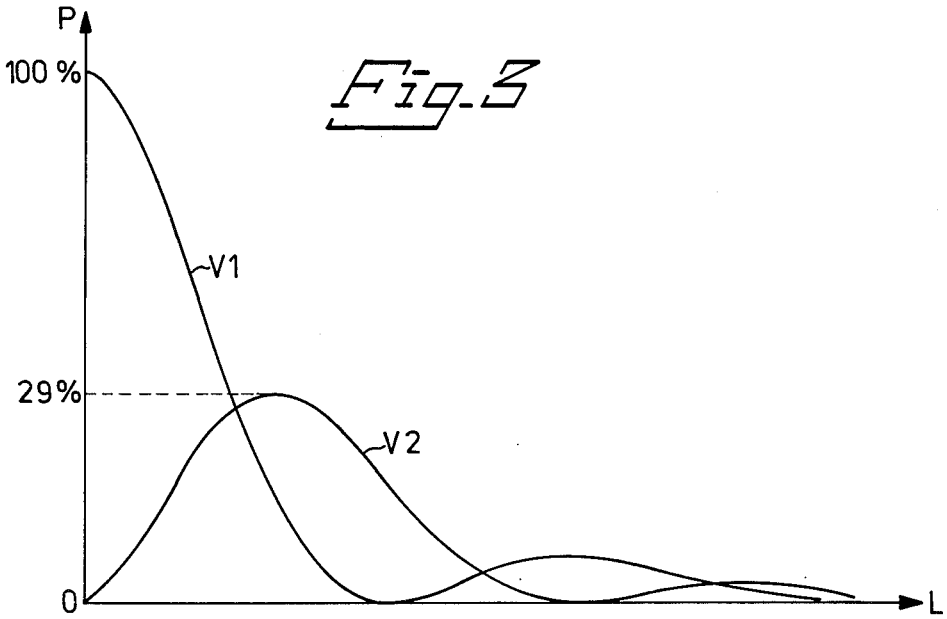
Figure 4:
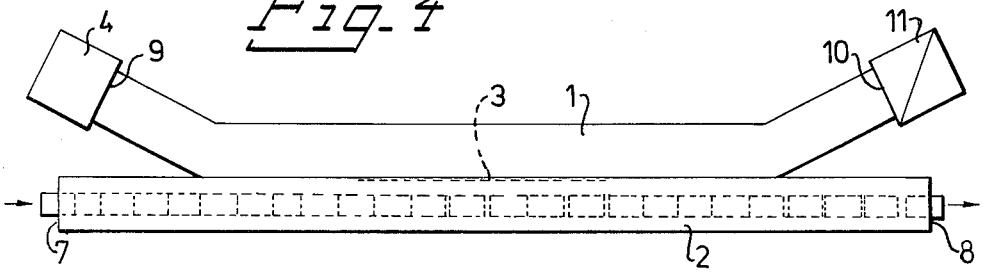
Figure 5:
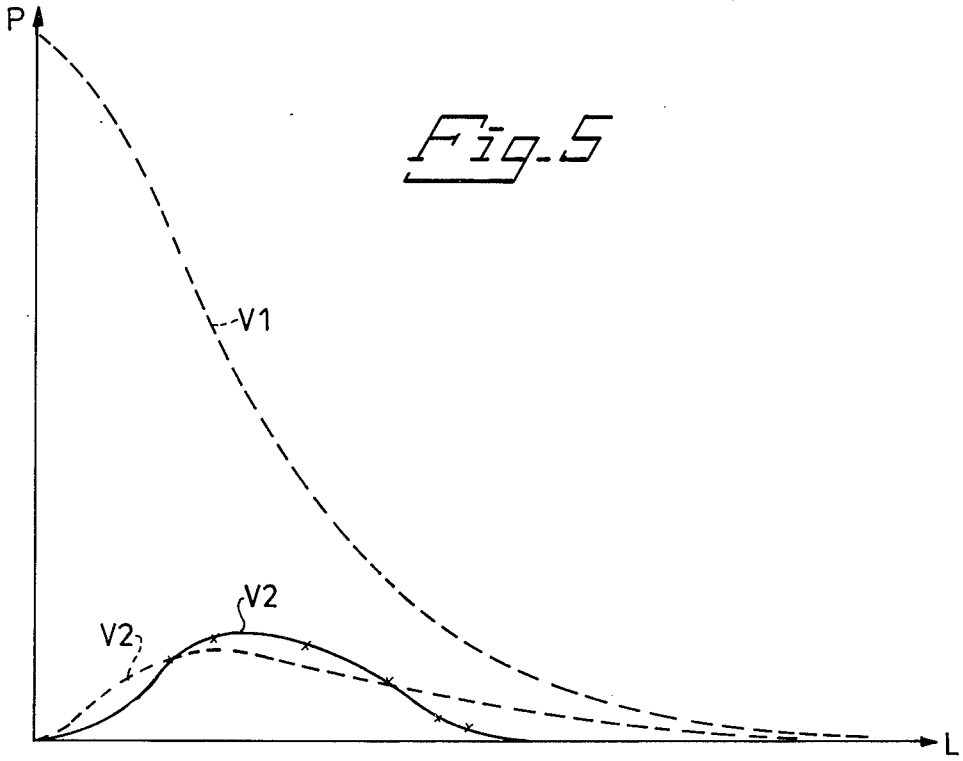
Figure 6:
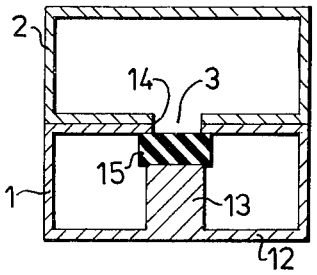
Figure 7:
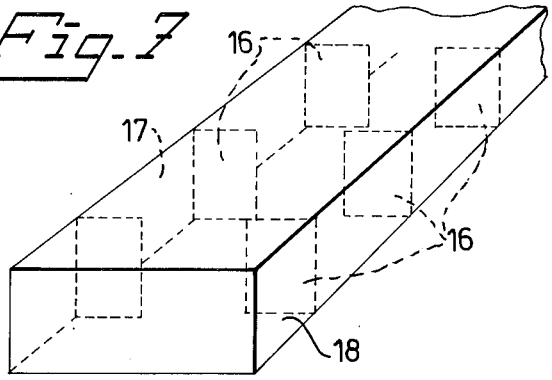

The invention is described in the following, with reference to the accompanying drawings, in which FIG. 1 shows two waveguides, FIG. 2 is a diagram on the coupling of energy between two waveguides where the propagation directions of the energy and the waves are the same, FIG. 3 is a diagram corresponding to that shown in FIG. 2, FIG. 4 shows schematically a device according to one embodiment of the invention, FIG. 5 is a diagram corresponding to the ones shown in FIGS. 2 and 3, FIG. 6 is a cross-section of two waveguides where a so-called ridge waveguide is used as feed waveguide, FIG. 7 shows a further embodiment of a feed waveguide.

As mentioned above in the introductory portion, the invention relates to a method and a device for microwave heating where microwave energy is transferred — coupled — between one or more waveguides, thereby eliminating many problems and shortcomings.

A device for carrying out said method comprises in principle in its simplest design a feed waveguide 1, a load waveguide 2, a coupling distance 3 and a microwave generator 4.

In FIG. 1 a feed waveguide 1 is shown, which may have oblong size and rectangular cross-section, and which at one end is connected to a microwave generator (not shown in FIG. 1), for example a magnetron, klystron or transistor-oscillator. The said waveguide is intended only for the feed of microwave energy. A load waveguide 2 has substantially the same dimensions as the feed waveguide and extends in parallel therewith in such a way, that the two waveguides 1,2 at least along a certain distance have a partition wall 5 in common. In this wall 5 a coupling distance 3 for transferring—coupling—of microwave energy from one waveguide to the other one is located. The coupling distance may consist of a slit 6, which with respect to microwave energy transport connects the two waveguides 1,2 The coupling distance may also consist of aerial elements such as holes, which several per wave length are positioned along the length of the coupling distance. The slit or the length of holes can be termed an elongated arrangement of an opening or openings through the wall.

The load waveguide 2 consists of a microwave applicator, the dimensions of which substantially are determined by the desired heat distribution in the products 19 to be heated. The products are fed into and out of the load waveguide 2 as indicated by arrows in FIG. 4.

According to the present invention, the load waveguide 2 is dimensioned so that the wave propagation constant, or the wave length, therein is the same as in the feed waveguide 1 when the load waveguide contains load to be heated.

When such is the case, microwave energy is coupled over from the feed waveguide 1 to the load waveguide 2 along the length of the coupling distance 3, when the load waveguide contains load. The microwave energy then can be coupled back to the feed waveguide 1 via an additional coupling distance 3 whereby, thus, both ends of the load waveguide, i.e. its feed-in end 7 and feed-out end 8, are free from microwave energy.

The basic theory for coupled modes is previously known and described a.o. in the publications J. R. Pierce, "Coupling of Modes of Propagation", J. Appl. Phys., 25, 179–183 (Feb. 1954), W. H. Lovisell, "Coupled Mode and Parametric Electronics", John Wiley & Sons, Inc. USA 1960, D. A. Watkins, "Topics in Electromagnetic Theory", John Wiley & Sons, Inc. USA 1958, S. E. Miller, "Coupled Wave Theory and Waveguide Applications" Bell Systems Tech. J., 33, 661–720 (May 1954). It is known in principle from this theory that energy is transferred between two waveguides, which are coupled along a distance, and in which it propagates modes with equal or almost equal wave propagation constant. The coupling takes place between modes propagating in the same direction.

The coupling between waves with the same wave propagation constant, but with propagation in opposite direction is extremely small. It is possible to oppress waves in opposite direction very strongly by a suitable choice of the length of the coupling distance.

In FIG. 2 is shown how the effect, which is marked by P along the y-axis, oscillates sinusoidally between two coupled waveguides, which are marked by V1,V2, along the length of a coupling distance marked by L. In order to couple over all effect between the waveguides V1, V2, as shown in FIG. 2, the wave progagation constants in the two waveguides must be equal. When they are slightly different, only a part of the effect is transferred, viz.

$$1/\left(1+\frac{\beta_2-\beta_1}{2k}\right)^2$$

of the effect. In said formula $\beta_1$ and, respectively, $\beta_2$ are the wave propagation or phase constants in the respective waveguide, and k is the coupling factor for the field per length unit. This implies that the coupling to other modes with different wave propagation constants can be oppressed.

The length, along which a certain relation exists between the effect in the waveguides, is determined by the size of the coupling factor. When the coupling distance has the length 1, it applies that all energy was transferred from one waveguide to the other one when $k \cdot l = \pi/2$.

When losses occur in the waveguide V2, the effect P is affected so, see FIG. 3, that the distribution between the waveguides along the coupling distance is not sinusoidal as in FIG. 2. At the example in FIG. 3 k=1.8/m, and the attenuation factor $\alpha = 1.8$/m. When the effect in the waveguide V1 is zero, it applies that the coupling length 1 is $$l = \pi/2\,[k^2-(\alpha/2)^2]^{-1}$$

It can be observed that the maximum effect in the waveguide V2 in FIG. 3 is substantially lower (29%) than the maximum effect in the waveguide V1.

According to a preferred embodiment of the device according to the present invention, a feed waveguide 1 and a load waveguide 2 are provided where products are fed-in into one end 7 of the load waveguide and fed-out at its other end 8. Microwave energy is fed-in at the end 9 of the feed waveguide 1, which end is located at the feed-in end 7 of the load waveguide. It further is preferred to provide at the other end 10 of the feed waveguide 1 a reflection-free water load 11 for extinguishing energy possibly remaining in the feed waveguide, see FIG. 4.

The feed waveguide 1 is coupled to the load waveguide 2 along a coupling distance 3. The dimensions of the load waveguide 2, as mentioned above, are chosen so that the waveguide, with intended load in the form of products, has the same or substantially the same wave propagation or phase constant as the feed waveguide 1.

Without load in the load waveguide 2, the wave propagation or phase constant of the load waveguide differs from that of the feed waveguide, and the effect, therefore, is not coupled over form the feed waveguide 1 to the load waveguide 2, but is converted to heat in the water load 11. The generator 4 thereby operates against an adjusted load, irrespective of whether load is coupled to the load waveguide or not. No microwave energy, thus, leaks out of the equipment.

When products 19 are being fed into the load waveguide 2, the wave propagation or phase constant is changed so as to be the same in the two waveguides 1,2. Thereby the energy is coupled over to the load waveguide 2, and the products are heated. The effect coupled-over is transported only in the wave propagation or phase direction, so that the feed-in of products does not give rise to any problems with respect to microwave leak, because there is no microwave energy at the feed-in end 7 of the load waveguide 2.

The length of the coupling distance 3 can be chosen so that at the point where the coupling ends, all effect is in the feed waveguide. Thereby all of the remaining microwave effect is transferred to the water load 11. In this way the feed-out end 8 of the load waveguide is free from microwave energy. The invention, thus, permits free passage of products to be heated without risk of microwave leakage.

The coupling distance 3, further, can be divided into two or more sections so that, for example, the first section transfers the effect from the feed waveguide 1 to the load waveguide 2, and the next section returns the effect to the feed waveguide 1.

At high attenuation in the load, it may be sufficient to transfer the effect to the load waveguide where it is entirely converted to heat in the products, before the products arrive at the feed-out end 8.

The maximum microwave effect in the load waveguide 2 is restricted either in that the electric field intensity must not become so high that an electric disruption is obtained, or in that the products do not withstand too rapid heating.

In a waveguide, which is fed directly by a generator or via a connection in a point, the heat development as well as the microwave effect fall exponentially in the direction of the effect transport.

The invention offers in this connection great advantages, in that the heat development can be distributed very uniformly in the wave propagation direction.

By arranging a low coupling, the effect in the load waveguide can be held considerably lower than in the feed waveguide.

FIG. 5, which is a diagram of the same type as shown in FIGS. 2 and 3, includes theoretical curves (dashed) and a measured curve (fully drawn) concerning the coupling between two waveguides V1, V2. The attenuation factor $\alpha$ is measured to be 3.9/m. and the coupling factor k to be 1.8/m. The coupling distance 3 was a continuous slit. By decreasing the coupling, the maximum effect in the load waveguide 2 for a predetermined effect fed into the feed waveguide 1 decreases.

It is also possible to maintain the energy density in the load waveguide 2 on the highest level by varying the coupling factor per length unit. The heating velocity can thereby be controlled by the time so that a desired heating process, for example a drying profile, is obtained.

When applying the invention, the microwave energy is caused to be transferred during a comparatively long distance, which implies that interferences of the field pattern in the applicator, i.e. load waveguide, are insignificant. A conventional discrete connection of effect to a load waveguide by, for example, a coil, an aerial or opening, as a matter of fact, brings about a strong local interference of the field configuration and thereby an interference of the heat distribution.

According to a further, preferred embodiment of the invention, the feed waveguide 1 or load waveguide 2 is designed so that its wave propagation or phase constant slowly is changed along its length. Hereby the load dependency is decreased, i.e. the effect of that variations in the load change the wave propagation or phase constant and therewith the strength of the coupling. This can be brought about by a continuous change of its dimensions or by inserting a low-loss dielectric material, the position of which in the waveguide and the dielectricity constant of which influence the wave propagation velocity of the waveguide.

When a dielectric material is inserted in the waveguide, the position of the material preferably is displaceable from outside so that the waveguide easily can be trimmed when the waveguide is in operation.

FIG. 6 is a cross-section of an embodiment of a flexible feed waveguide 1 according to the invention. It consists of a so-called ridge waveguide 12, for example according to SE-PS 366 456, where the effect is concentrated to a zone between a ridge 13 and the slit 14 of the coupling distance 3. A dielectric material 15 is provided between the ridge 13 and slit 14. By reducing the distance between the ridge 13 and slit 14, the effect concentration increases, and the coupling to the load waveguide 2 gains in strength.

The wave propagation constant can be caused to assume different values by filling a greater or smaller portion of the ridge waveguide 12 with a low-loss dielectric material. The dielectric constant together with the geometric dimensions determine the wave propagation constant of the ridge waveguide.

In order to obtain high values of the wave propagation constant, the feed waveguide 1 is designed with a periodic structure where periodically arranged diaphragms extend from two opposed inner walls 17,18 of the feed waveguide 1, as shown in FIG. 7.

Besides the aforementioned advantages can be stated that, due to the operation of the generator against a reflection-free load, the service life of the generator is much longer than it usually is the case. This applies especially to magnetrons, which predominantly are used as microwave generators for heating purposes.

It can further be stated that for materials with low losses a high efficiency degree on a short distance and a good tolerance against variations in the load are obtained.

The wavelength is long and thereby yields a small variation of the heating in longitudinal direction.

The invention is not restricted to the embodiments described above. Several load waveguides, for example, can be fed by one feed waveguide, in which case the load waveguides 2 are placed in parallel on two respective sides of the feed waveguide 1. Furthermore, several feed waveguides can in corresponding manner feed effect to one load waveguide.

According to another embodiment, several feed waveguides can couple energy to one load waveguide, where the connection takes place in the same position to different modes in the load waveguide, or the feed waveguides subsequently one after the other couple energy to the same mode in the load waveguide.

The feed-in opening 7 of the load waveguide 2 also can be dimensioned so that it has a so-called cut-off frequency, which is lower than the generator frequency, and a feed-out opening 8 with a cut-off frequency, which is higher than the generator frequency.

The invention, thus, must not be regarded restricted to the embodiments described above, but can be varied within the scope of the attached claims.

We claim:

1. A device for heating objects by means of microwave energy, comprising a first feed waveguide with a generator for the supply of microwave energy to said first waveguide, comprising an additional second load waveguide, located adjacent the first waveguide so that the two waveguides at least along a certain distance are parallel and have a partition wall in common, in which partition wall an elongated coupling aperture means is located, said elongated coupling aperture means having a length, by means of which length a coupling of microwave energy distributed in the wave propagation direction of the waveguides takes place from one of said waveguides to the other one and that the load waveguide is dimensioned so that it, when under a no load condition, has a wave phase constant sufficiently different from that of the feed waveguide so that essentially no energy is coupled from the feed waveguide to the load waveguide and also, by action of intended load in the form of objects to be heated in the load waveguide, to conduct microwave energy with the same wave phase constant as the first feed waveguide.

2. A device as defined in claim 1, characterized by means included in said first waveguide enabling the cross-sectional dimensions of the first waveguide to be continuously changed along at least a section of its length, whereby the wave propagation for energy transported in the first waveguide is changed.

3. A device as defined in claim 1, characterized in that a dielectric material is inserted in the first waveguide at least along a section of its length, whereby the wave propagation velocity for energy transported in the waveguide is changed.

4. A device as defined in claim 1, characterized in that said partition wall comprises several lengths of elongated coupling aperture means for coupling-over microwave energy from the first waveguide to the second waveguide and thereafter back to the first waveguide at least once, the number of said lengths of coupling aperture means being equal to the number of said transfers.

5. A device as defined in claim 4, characterized by means included in said first waveguide enabling the cross-sectional dimensions of the first waveguide to be continuously changed along at least a section of its length, whereby the wave propagation for energy transported in the first waveguide is changed.

6. A device as defined in claim 4, characterized in that a dielectric material is inserted in the first waveguide at least along a section of its length, whereby the wave propagation velocity for energy transported in the waveguide is changed.

7. A device as defined in claim 1, wherein there are a plurality of lengths of the elongate coupling aperture means located in the partition wall the total length of the coupling means enabling transferring microwave energy fed into the first waveguide to the second waveguide and back to the first waveguide, and that the first waveguide terminates in a reflection-free load for example a water load.

8. A device as defined in claim 1, characterized in that the first waveguide is connected by plural lengths; independent elongate coupling means to at least two second waveguides.

9. A device as defined in claim 1, characterized in that at least two of said first waveguides are connected by plural lengths of independent elongate coupling means to one second waveguide.

10. A device in claim 1, characterized in that the first waveguide is a ridge waveguide.

11. A method of heating objects by means of microwave energy, utilizing at least one feed waveguide comprising a generator and a first waveguide, and a load waveguide comprising a second waveguide, with load inlet and load outlet, located separate from the first wave guide except for at least one adjacent and parallel elongated coupling aperture means between the waveguides, which coupling aperture means consists of a length, during, and by means of which a coupling of microwave energy distributed in the wave propagation direction of the waveguides is caused to take place so that microwave energy passes from the first waveguide to the second waveguide, except when there is a no load condition existing in the second waveguide; the second waveguide being dimensioned so as, by action of load in said second waveguide in the form of the objects to be heated, to conduct microwave energy with the same wave phase constant as said first waveguide and when there is no load in said second waveguide that essentially no energy will be coupled from the first waveguide to the second waveguide, the steps of feeding objects, to be heated, into and out of only the second waveguide, feeding microwave energy only into the first waveguide and propagating said microwave energy into the second waveguide at said elongated coupling aperture means location.

12. A method as defined in claim 11, characterized in that the wave phase constant in the first waveguide is caused to continuously be changed along its length, by changes in the dimensions of the waveguide.

13. A method as defined in claim 11, characterized in that the wave propagation velocity in the first waveguide is caused to be changed along the length thereof by inserting a dielectric material, preferably a ceramic material, in the waveguide.

14. A method as defined in claim 11, characterized in that microwave energy is caused to pass from the first waveguide to the second waveguide and back again to the first waveguide at least once by utilizing the number of coupling distances between the waveguides which is equal to the number of intended passages of energy between the waveguides.

15. A method as defined in claim 14, characterized in that the wave phase constant in the first waveguide is caused to continuously be changed along its length, by changes in the dimensions of the waveguide.

16. A method as defined in claim 14, characterized in that the wave propagation velocity in the first waveguide is caused to be changed along the length thereof by inserting a dielectric material, preferably a ceramic material, in the waveguide.

17. A method as defined in claim 11, characterized in that at least ahead of the terminating end of the waveguides all remaining microwave energy is coupled over to the first waveguide whereafter this energy is caused to be converted to heat in a load, for example water load, located at the end of the first waveguide.

18. A method as defined in claim 11, characterized in two microwave generators are caused to introduce energy each in an associated waveguide, and causing the microwave energy in all such waveguides to be coupled over to a waveguide provided for the heating of objects.

19. A method as defined in claim 11, characterized in that a microwave generator is caused to introduce energy into a waveguide, and causing the microwave energy in this waveguide to be coupled over to at least two waveguides provided for the heating of objects.

* * * * *